United States Patent [19]

Stange et al.

[11] 4,033,579

[45] July 5, 1977

[54] OFFSET STACKER

[75] Inventors: Klaus K. Stange, Pittsford; Richard E. Smith, Webster; Thomas J. Hamlin, Macedon; James R. Cassano, Penfield, all of N.Y.

[73] Assignee: Xerox Corporation, Stamford, Conn.

[22] Filed: Mar. 11, 1976

[21] Appl. No.: 665,827

[52] U.S. Cl. ..... 271/195; 271/217

[51] Int. Cl.[2] ..... B65H 31/10

[58] Field of Search ..... 271/195, 176, 194, 207, 271/217, 227, 238, 240, 248, 250

[56] References Cited

UNITED STATES PATENTS

| | | | |
|---|---|---|---|
| 2,645,480 | 7/1953 | Long | 271/207 X |
| 2,981,411 | 4/1961 | Azari | 271/64 X |
| 3,243,181 | 3/1966 | Lyman | 271/64 |
| 3,834,799 | 9/1974 | Blosser | 271/195 X |
| 3,866,906 | 2/1975 | Berry | 271/227 |
| 3,918,706 | 11/1975 | Craft | 271/195 X |

*Primary Examiner*—Richard A. Schacher
*Attorney, Agent, or Firm*—Carlos Nieves; James J. Ralabate

[57] ABSTRACT

A stacker includes a rectangular housing within which there is located a vertically movable platform. A vertical wall of the housing includes, along an upper region, an orifice through which sheets may be fed into the housing, and each of the other three vertical walls includes a series of fluid outlet ports, at the same level as the orifice, each series of ports being coupled to a vacuum source. The top of the housing includes an array of fluid inlet ports which are coupled to a fluid source. The fluid source cooperates with outlet ports and vacuum sources to create a fluid stream in the housing which biases a sheet entering through the orifice, selectively, against one of two corners in the housing. Sheets in the housing are also biased towards the platform by movable spring members extending into the housing through the orifice. The spring members are moved out of the way of a sheet entering the housing through the orifice by a detector which controls a solenoid yoked to the spring members. Tension in the springs is detected to position the platform in the housing so that the top-most sheet supported by the platform is located at a predetermined level.

6 Claims, 4 Drawing Figures

OFFSET STACKER

The subject invention relates to devices for stacking articles or sheets of, for example, paper. In addition, the invention relates to fluidic devices used to register documents, such as disclosed in co-pending U.S. patent application Ser. No. 627,571, Pneumatic Registration Apparatus, filed on Oct. 31, 1975, on an invention by Klaus K. Stange, said application being assigned to the assignee herein, Xerox Corporation.

U.S. Pat. 3,654,040, Stacker With a Labeling Machine, issued to D. W. Watson on Apr. 4, 1972, discloses prior art which is considered to be relevant herein. More specifically, said patent makes it clear that persons skilled in the art of stacking articles are aware that articles may be stacked on a descending platform, and that movement of the platform can be made dependent on the location of the top-most article supported by the platform. U.S. Pat. No. 3,458,383, Mailing Piece Separator, issued on July 29, 1969 to H. V. Kirk et al., is also relevant herein because it discloses a kickout mechanism which is used to offset articles delivered to a platform.

It is an object of the present invention to provide an improved stacker capable of stacking articles in subgroups on a platform.

It is another object of the present invention to provide a stacker wherein articles are fluidically aligned to provide a stack having identifiable groups of articles.

It is still another object of the present invention to provide a stacker wherein articles may be stacked in subgroups and articles corresponding to subgroups are aligned along two edges.

Briefly, the invention herein provides apparatus for stacking supplied sheets. Structurally, the apparatus includes (a) a housing having an orifice; (b) fluidic means for selectively moving sheets fed through the orifice against opposite sides of the housing; and (c) means for vertically supporting sheets fed through the orifice.

Additional objects and features of the invention will become apparent by reference to the following description in conjunction with the accompanying drawings, in which.

Figure 1:
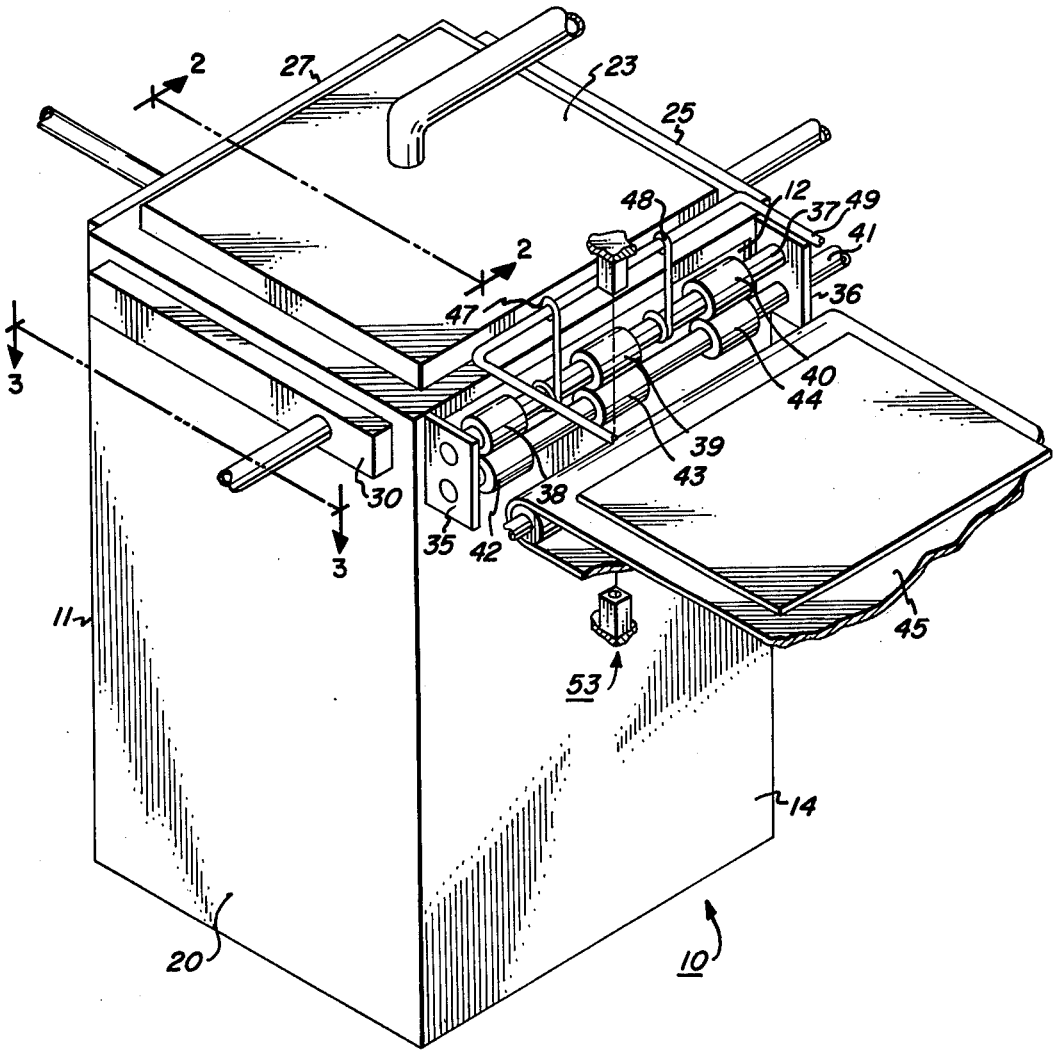
FIG. 1 is a partial perspective view of a stacker, according to the invention.
Figure 2:
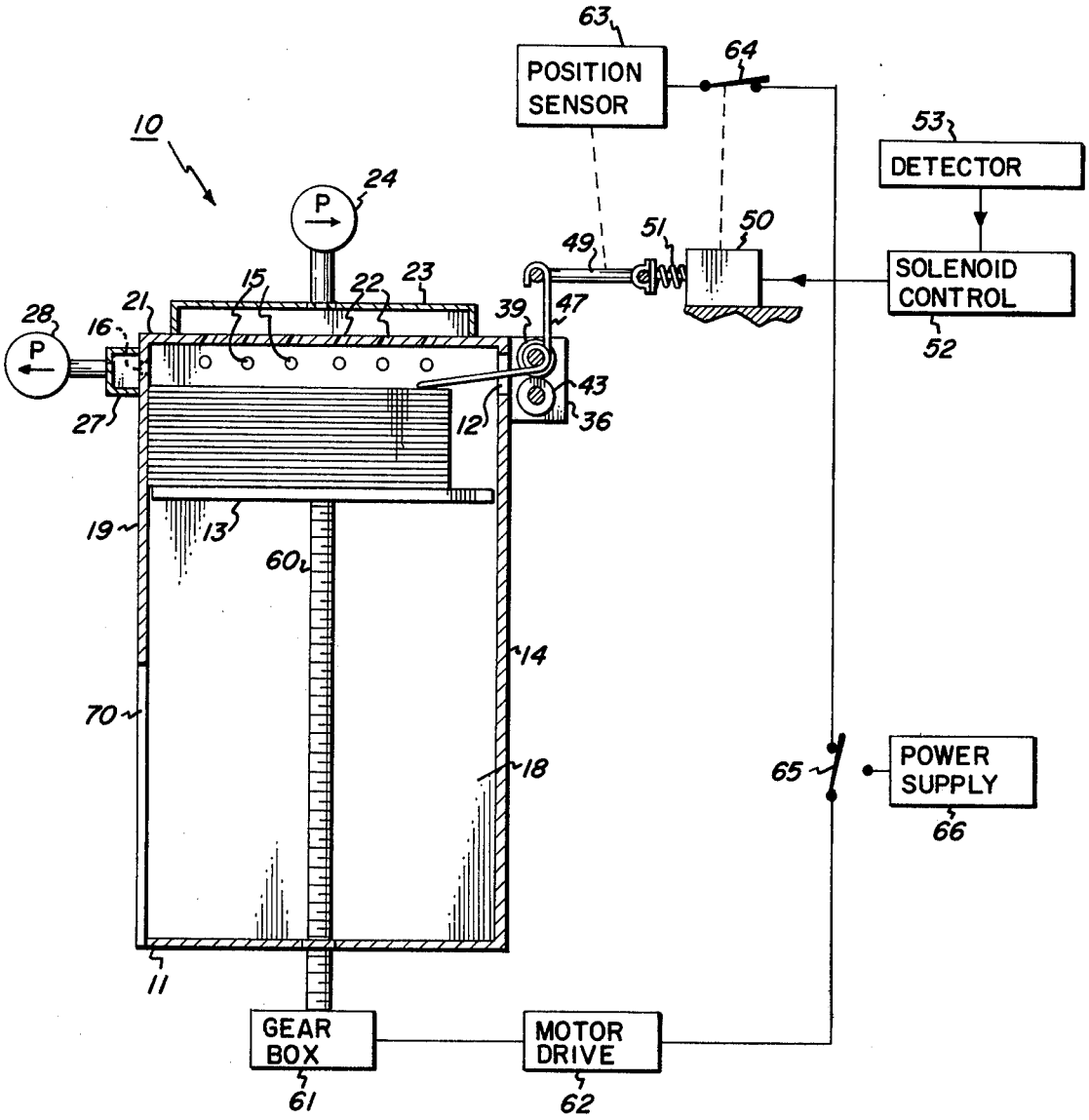
FIG. 2 is a cross-sectional view of part of the stacker, taken along line 2—2 in FIG. 1, and schematically represented cooperating parts.
Figure 3:
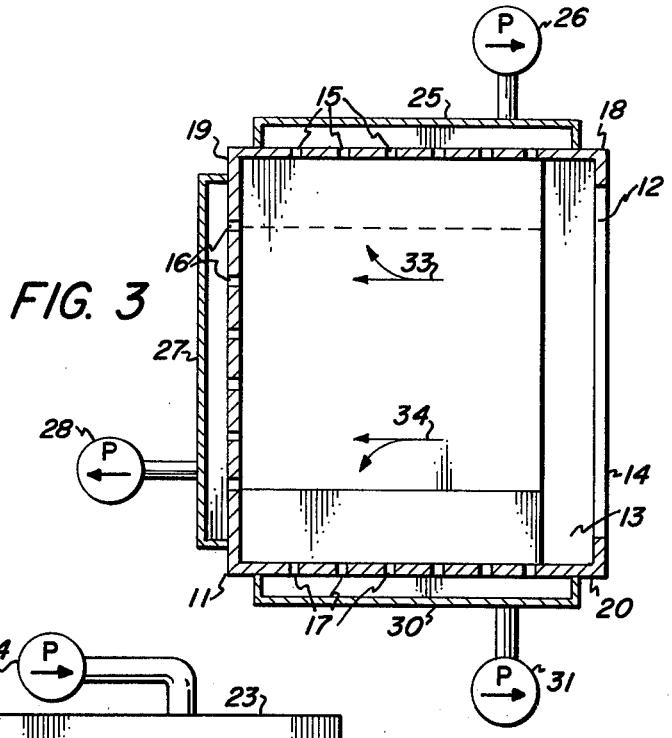
FIG. 3 is a cross-sectional view of the stacker, taken along line 3—3 in FIG. 1.

Referring to FIGS. 1, 2, and 3, a stacker 10, according to the subject invention, includes a rectangular housing 11 having an orifice 12 through which sheets to be stacked are inserted and a platform 13 (see FIG. 2) in the housing on which fed sheets are supported. Orifice 12 is located along an upper region of a vertical wall 14 of the housing and is horizontally aligned (see FIG. 3) with three different groups of outlet ports 15, 16, 17 located, respectively, on the three other vertical walls 18, 19, 20 of the housing. The top wall 21 of the housing (see FIG. 2) includes an array of inlet ports 22 pointing in the direction of wall 19, and supports a manifold 23 whose chamber communicates with the inlet ports and is coupled to a fluid pump 24. Wall 18 supports a manifold 25 (see FIG. 3) whose chamber communicates with outlet ports 15 and is coupled to a vacuum pump 26, wall 19 supports a manifold 27 whose chamber communicates with outlet ports 16 and is coupled to a vacuum pump 28, and wall 20 supports a manifold 30 whose chamber communicates with outlet ports 17 and is coupled to a vacuum pump 31. Therefore, if pumps 24, 26 and 28 are turned on a fluid stream 33 having velocity components normal to walls 18 and 19 is created in the housing and if pumps 24, 28 and 31 are turned on a fluid stream 34 having velocity components normal to walls 19 and 20 is created in the housing. As will appear, the fluid streams may be used to provide an offset stack of sheets from sheets serially fed into the housing through the orifice.

Referring to FIGS. 1 and 2, on housing 11 there is fixed a pair of brackets 35 and 36, flanking orifice 12, which support a rod 37 on which rollers 38–40 are rotatably mounted and rotatable rod 41 supporting rollers 42–44. Rollers 38–40 cooperate with rollers 42–44, respectively, to provide nips and rods 41 is rotated by a rotary drive (not shown) to move sheets presented by a conveying device 45 into the housing.

Rod 37 supports a rotatable spring member 47 between rollers 38 and 39 and another rotatable spring member 48 between rollers 39 and 40, each spring member being coupled at one end to a yoke 49 and having a ski section which extends through orifice 12. Yoke 49 may be moved in one direction to rotate the ski sections so that they do not interfere with movement of sheets into the housing and may be moved in an opposite direction to rotate the ski sections against the platform or sheets supported on the platform. As shown in FIG. 2, Yoke 49 is coupled to a solenoid 50 for pulling the yoke in one direction and to a compression spring 51 for pushing the yoke in the opposite direction. Solenoi 50 is coupled to a control 52 which responds to a sheet detector 53. Detector 53 may be, for example, an electric eye located between the conveying device 45 and housing 11. When the detector is actuated, by the presence of a moving sheet, the yoke is pulled and the ski sections are lifted. After the sheet has moved past the detector the solenoid is inactivated and the compression spring moves the yoke until the ski sections engage and provide a balancing force.

Figure 4:
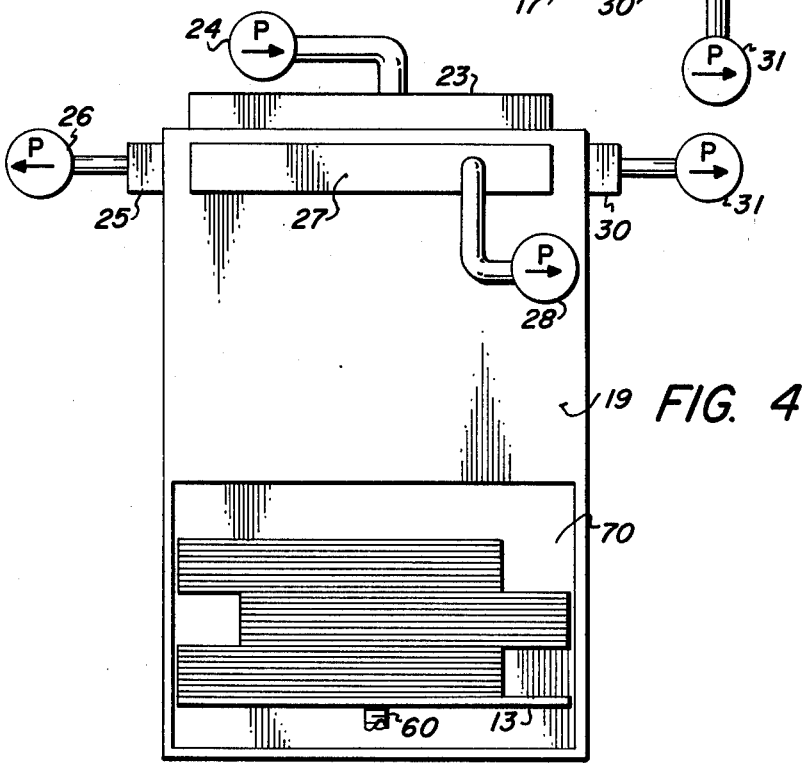
FIG. 4 is a side plan view of the stacker, the view showing an opening through which stacked sheets may be removed.

The magnitude of the balancing force is related to the location of the top-most sheet of a stack of sheets in the housing and, therefore, the rest position of the yoke is related to the position of said top-most sheet. To maintain the top-most sheet at a predetermined level in the housing the position of the yoke is detected and a derived signal is used to move the platform until the yoke is moved to a predetermined location corresponding to the location of the top-most sheet at the predetermined level. In the present embodiment of the invention the platform is connected via a lead screw 60 and a gear box 61 to a motor drive 62 and the motor drive is coupled to a position sensor 63 which can be (not shown) a potentiometer coupled to a power supply and the yoke. As shown in FIG. 2, the solenoid 50 is also coupled to a switch 64 in series with the position sensor and the motor drive. Switch 64 is opened by the solenoid when it is activated to prevent a following of the ski sections when they are lifted to permit the entry of a sheet into the housing. Motor drive 62 may be disconnected from the position sensor and connected via a switch 65 to a variable power supply 66 and power supply 66 may be used to generate signals for moving the platform up and down independently of the position of the yoke. As a result, stacked sheets may be moved opposite an opening 70 on wall 19 of the housing for removal (see FIG. 4).

In a typical operating situation the stacker described is empty and the platform 13 is located immediately below the orifice. When a sheet is to be fed to the stacker pump 24, pump 28, and either one of pumps 26 and 31 are activated. As the sheet is moved towards the housing, its leading edge is sensed, the sheet is engaged by rollers and is moved towards the orifice, and the spring members are moved out of the way of the sheet entering the housing. As the sheet moves, its trailing edge is sensed and when the sheet is released by the rollers fluidic forces move the sheet into abutment with orthogonally related walls corresponding to the selection of pump 26 or 31. In response to the sensed trailing edge the ski sections of the spring members are moved downwardly and bias the registered sheet against the platform. At this point the servomechanism described moves the platform so that the top of the sheet is located at a predetermined level previously occupied by the top of the platform. As other sheets are similarly fed they are stacked and aligned along at least two edges. At any time during the stacking process the initial selection of pumps 26 or 31 may be changed to align sheets being fed against another set of orthogonally related walls. Therefore, it should be appreciated that sheets may be stacked in offset groups.

It should be noted that the servomechanism described for moving the platform as sheets are fed may be replaced by other mechanisms which are independent of the spring members and that such mechanisms are well known by persons skilled in that art. Since such a replacement or other replacements may be made readily without deviating from the spirit of the invention, it is to be understood that the description herein of a preferred embodiment, according to the invention, has been set forth as an example thereof and is not to be construed or interpreted to provide limitations on the claims which follow and define the invention.

What is claimed is:

1. Apparatus for stacking supplied sheets comprising:

a. a rectangular housing having a first wall with an orifice, a second wall opposite the first wall, a third wall orthogonally related to the second wall, and a fourth wall orthogonally related to the second wall;

b. fluidic means for selectively moving sheets fed through the orifice against the third or fourth wall of the housing and the second wall; and c. means for vertically supporting sheets fed through the orifice, including a platform to maintain the top-most sheet supported thereby at a predetermined location and means for moving the platform to maintain the top-most sheet on the platform at a predetermined location.

2. Apparatus as defined in claim 1 wherein said housing includes an opening and said means for moving the platform includes means for independently lowering the platform, whereby stacked sheets may be removed through the opening.

3. Apparatus as defined in claim 1 wherein said fluidic means includes: a first series of outlet parts located on the third wall; a second series of outlet ports located on the fourth wall; and means for forcing fluid through either of said series of ports, thereby biasing a sheet fed through the orifice against the third or fourth wall.

4. Apparatus as defined in claim 3 wherein said means for forcing fluid includes: means for injecting fluid into the housing; a first manifold, coupled to the housing, having a chamber communicating with said first series of ports; a second manifold, coupled to the housing, having a chamber communicating with said second series of holes; and means for selectively providing a vacuum pressure to the first or second manifolds.

5. Apparatus as defined in claim 4 wherein the second wall includes a third series of output ports; wherein the housing supports a third manifold, the chamber of the third manifold communicating with the third series of ports; and wherein a vacuum pump is coupled to the third manifold.

6. Apparatus as defined in claim 4 wherein said means for injecting fluid into the housing includes: an array of inlet ports located in the housing; a manifold, coupled to the housing, having a chamber in communication with the array; and a fluid pressure pump coupled to the manifold.

* * * * *